US011759087B2

(12) United States Patent
Feddema

(10) Patent No.: US 11,759,087 B2
(45) Date of Patent: Sep. 19, 2023

(54) DISHWASHER PADDLE WHEEL ASSEMBLY

(71) Applicant: WHIRLPOOL CORPORATION, Benton Harbor, MI (US)

(72) Inventor: Mark Feddema, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 2 days.

(21) Appl. No.: 17/069,963

(22) Filed: Oct. 14, 2020

(65) Prior Publication Data

US 2022/0110503 A1 Apr. 14, 2022

(51) Int. Cl.

| | |
|---|---|
| ***A47L 15/42*** | (2006.01) |
| ***A47L 15/50*** | (2006.01) |
| ***A47L 15/06*** | (2006.01) |
| ***A47L 15/00*** | (2006.01) |
| ***B05B 3/04*** | (2006.01) |

(52) U.S. Cl.

CPC ..... *A47L 15/0065* (2013.01); *A47L 15/4282* (2013.01); *A47L 15/50* (2013.01); *B05B 3/0486* (2013.01)

(58) Field of Classification Search

CPC ..... A47L 15/23; A47L 15/22; A47L 15/18; A47L 15/14; A47L 15/4282

See application file for complete search history.

(56) References Cited

U.S. PATENT DOCUMENTS 2,024,952 A * 12/1935 Snyder ..... A47L 15/06 134/186
2,100,343 A * 11/1937 Othmar ..... A47L 15/18 239/752
2,236,791 A * 4/1941 Forsberg ..... A47L 15/18 134/183
2,704,084 A * 3/1955 James ..... A47L 15/16 239/513
2,935,207 A * 5/1960 Miller ..... A47L 15/505 211/74
3,051,184 A * 8/1962 Gibson ..... A47L 15/0089 134/107
3,176,697 A * 4/1965 Gibson ..... A47L 15/0089 134/183

(Continued)

FOREIGN PATENT DOCUMENTS

CN 204581195 U 8/2015
CN 206285085 U 6/2017

(Continued)

*Primary Examiner* — Joseph L. Perrin
*Assistant Examiner* — Irina Graf
(74) *Attorney, Agent, or Firm* — Brooks Kushman, P.C.

(57) ABSTRACT

A dishwasher assembly may include a dishwasher rack including at least one drinkware row configured to hold drinkware along a length of the rack, a sprayer configured to provide at least one stream of liquid into the drinkware, and a paddle wheel assembly arranged between the drinkware row and the sprayer and including at least one paddle configured to rotate responsive to force of the at least one stream of liquid against the at least one paddle, such that during rotation the at least one paddle is configured to variably deflect at least a portion of the stream onto a plurality of portions of an interior surface of the drinkware.

6 Claims, 6 Drawing Sheets

(56) References Cited

U.S. PATENT DOCUMENTS

| | | | | |
|---|---|---|---|---|
| 3,368,573 | A * | 2/1968 | Mixon | A47L 15/23 239/231 |
| 5,470,142 | A | 11/1995 | Sargeant et al. | |
| 5,673,714 | A * | 10/1997 | Campagnolo | A47L 15/4282 134/179 |
| 6,814,091 | B2 | 11/2004 | McConnell et al. | |
| 7,695,571 | B2 | 4/2010 | Purtilo et al. | |
| 8,939,162 | B2 | 1/2015 | Winkler et al. | |
| 10,376,126 | B2 | 8/2019 | Gao et al. | |
| 2005/0178414 | A1* | 8/2005 | Kang | B05B 3/0486 134/179 |
| 2009/0056754 | A1* | 3/2009 | Rolek | A47L 15/4295 134/18 |
| 2011/0030742 | A1* | 2/2011 | Dalsing | A47L 15/508 134/198 |
| 2016/0106295 | A1* | 4/2016 | Thiyagarajan | A47L 15/4282 134/182 |
| 2017/0245726 | A1* | 8/2017 | Lee | A47L 15/16 |
| 2018/0344127 | A1 | 12/2018 | Gocmen et al. | |
| 2019/0380559 | A1 | 12/2019 | Lee et al. | |

FOREIGN PATENT DOCUMENTS

| | | | | |
|---|---|---|---|---|
| DE | 102018206443 | A1 | 10/2019 | |
| EP | 2225996 | A1 * | 9/2010 | A47L 15/14 |
| EP | 3266361 | A1 | 1/2018 | |
| JP | S6425065 | U * | 2/1982 | A47L 15/42 |
| WO | 2018045807 | A1 | 3/2018 | |

* cited by examiner

DISHWASHER PADDLE WHEEL ASSEMBLY

TECHNICAL FIELD

Disclosed herein are dishwasher paddle wheel assemblies.

BACKGROUND

Dishwashers have become standard kitchen appliances in homes. Dishwashers provide for automatic washing of dishes arranged on various racks within the dishwasher. These racks may be movable from the interior of the dishwasher cabin so as to be accessible to the user for loading and unloading. Efficiency both in space saving, as well as loading capabilities, is an important feature for personal use dishwashers.

SUMMARY

A dishwasher assembly may include a dishwasher rack including at least one drinkware row configured to hold drinkware along a length of the rack, a sprayer configured to provide at least one stream of liquid into the drinkware, and a paddle wheel assembly arranged between the drinkware row and the sprayer and including at least one paddle configured to rotate responsive to force of the at least one stream of liquid against the at least one paddle, such that during rotation the at least one paddle is configured to variably deflect at least a portion of the stream onto a plurality of portions of an interior surface of the drinkware.

A dish rack assembly for a dishwasher may include at least one wire frame defining an angled cavity configured to hold drinkware, a sprayer arranged adjacent the wire frame along the cavity and configured to provide at least one stream of liquid into the drinkware, and a paddle wheel assembly arranged on the wire frame along the cavity between the cavity and the sprayer and including at least one paddle configured to rotate responsive to force of the at least one stream of liquid against the at least one paddle to variably deflect at least a portion of the stream onto a plurality of portions of an interior surface of the drinkware.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompanying drawings in which:

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

A dishwasher may include racks having spaces designed to hold specific types of dishes, such as drinkware, cups, mugs, etc. These specializations aim for efficient loading, while also providing for flexibly with respect to the size and type of dish item that may fit within the type-specific design. In one example, the dishwasher may have a rack designed to hold drinkware at a shallow angle, where the drinkware may be cleaned by a rotatable sprayer arranged at or near the mouths of the drinkware. In some of these examples, it is not desirable to have a rotatable sprayer either due to cost or space constraints. In these situations, a static sprayer may provide for a fixed stream of liquid that sprays into the open end of the drinkware.

However, in well-soiled or tall glasses, this stream may not reach the entire inner bowl of the drinkware and, therefore, may not thoroughly clean the drinkware. To improve cleaning performance, a paddle wheel assembly may be arranged on the dishwasher rack, just below the drinkware holder area. The paddle wheel assembly may be a multiple bladed paddle wheel that rotates about a fixed rack wire. The paddle wheel's blades may have different lengths, or geometries, which would deflect fluid in two different directions or at different pressures. The different lengths allow for various deflected spray patterns so that liquid may hit various portions of the drinkware.

Figure 1:
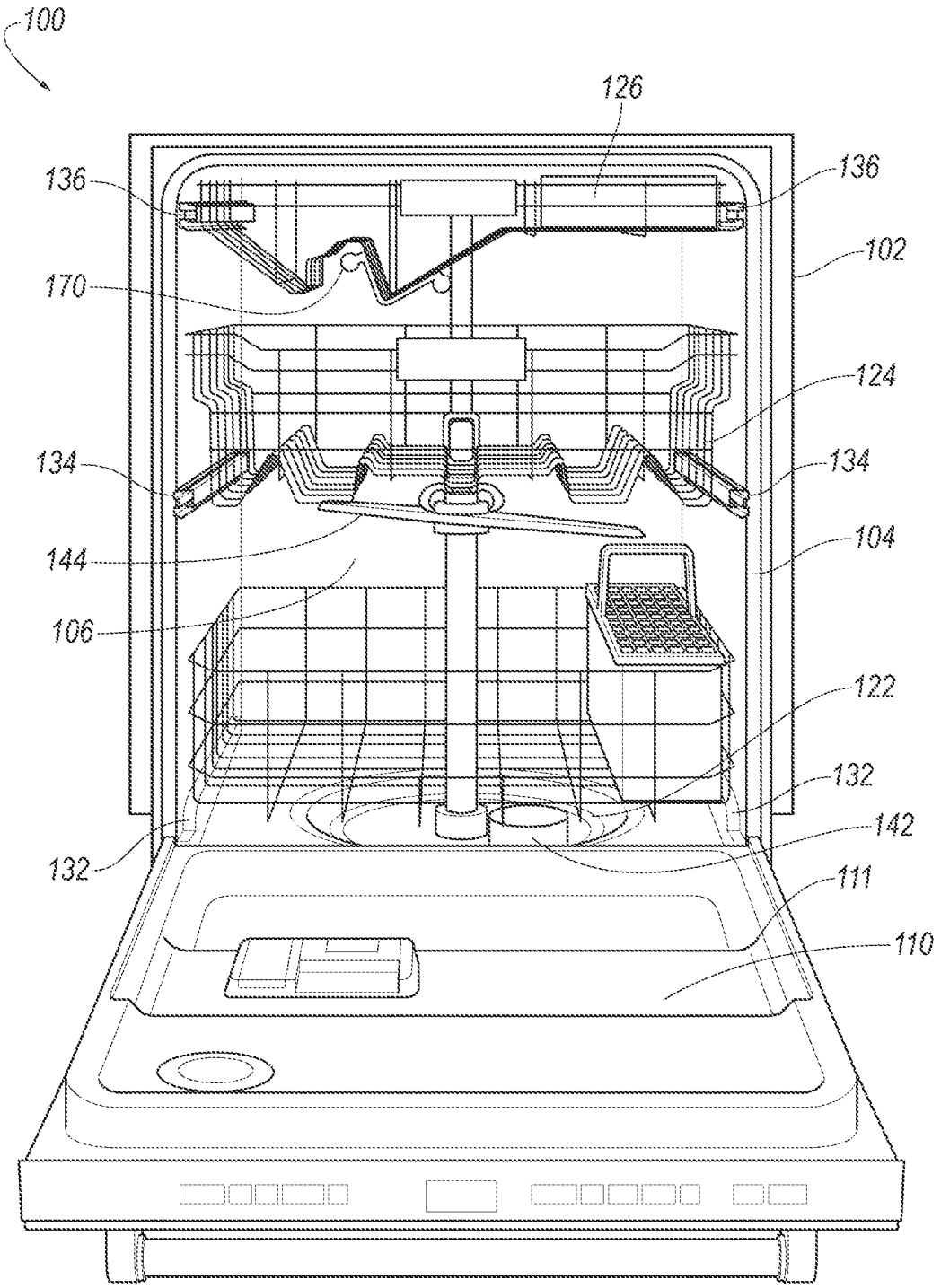
FIG. 1 illustrates an example front perspective view of a dishwasher in accordance with one example embodiment.

FIG. 1 illustrates an example front perspective view of a dishwasher 100 in accordance with one example embodiment. The dishwasher 100 may be an automated appliance configured to clean kitchen equipment placed within the dishwasher 100. The kitchen equipment may include tableware such as dishes, glassware, cutlery and other utensils, and well as food preparation equipment such as pots and pans, slicers, presses, and peelers. To perform the cleaning, the kitchen equipment is placed on dish racks 122, 124, 126 inside a tub 104 of the dishwasher 100. A door assembly 110 is closed to form a watertight seal around the tub 104. Washing liquid and rinsing liquid is propelled from jets onto the kitchen equipment to clean dirt, grease, and other contaminants off the kitchen equipment. While many examples described herein are generally related to in-home and personal use dishwashers, the same concepts are applicable to commercial dishwashers as well.

The dishwasher 100 may include a frame 102 defining the exterior of the dishwasher 100. The frame 102 may be configured to interface with components exterior to the dishwasher 100 for installation, such as cabinets, countertops, floors, etc. The frame 102 may include a top, left side, right side, back, and bottom.

The tub 104 may define a hollow cavity or interior of the dishwasher for washing dishes. The tub 104 may define an open-face, or access opening 106 with walls at the top, left side, right side, back and bottom. A chassis (not individually labeled) may be arranged between the frame 102 and the tub 104 to maintain the tub 104 within the frame. The chassis may support the tub 104 and allow for maintaining space between the frame 102 and the tub 104.

A door assembly 110 may be arranged at a front of the dishwasher 100. The door assembly 110 may be attached to the dishwasher at the bottom front edge of the frame 102 and may be hinged thereat to move between open and closed positions. In the closed position, the door assembly 110 may seal the tub 104 at the access opening 106. In the open position, the cavity may be accessible via the access opening. In another example, the door assembly 110 may operate as a drawer that can be slidably extended outward from the front of the dishwasher 100 to move into the open position, and slidably retracted back into the dishwasher 100 to the closed position to seal the tub 104.

The tub 104 may house at least one dish rack. In the example shown in FIG. 1, the dishwasher 100 includes a lower dish rack 122, a middle dish rack 124, and an upper dish rack 126. It should be noted that while three disk racks are shown, this is only one example, and dishwashers 100 with more or fewer dish racks are possible. For instance, a dishwasher 100 may include a single rack or more than three racks.

Regardless of quantity or arrangement, the dish racks 122, 124, 126 may be designed to hold the kitchen equipment in place for cleaning by the dishwasher 100. In many examples the dish racks 122, 124, 126 are wire frame racks that allow for the flow of liquid within the tub 104. The dish racks 122, 124, 126 may also be made of (or coated with) plastic or other materials. The dish racks 122, 124, 126 may generally include tines or other projections to allow the kitchen equipment to be washed to be held in a spaced apart relationship, such that the washing liquid and rinsing liquid can be projected onto the exposed kitchen equipment surfaces for cleaning these surfaces.

The dish racks 122, 124, 126 are generally adapted to move between a retracted wash position within the tub 104 and an extended position outside the tub 104 for loading and unloading of the kitchen equipment to be washed. The racks typically include wheels or rollers for rolling movement along tracks or guides to the retracted and extended positions. In the illustrated example, the lower dish rack 122 includes rollers or wheels that cooperate with a first track rail 132 formed at the bottom wall of the tub 104. A door track 111 may be arranged on the door assembly 110 as shown to allow the first rack to be rolled into an extended position when the door assembly 110 is open. The middle dish rack 124 is generally mounted within the tub 104 along a pair of second track rails 134 that cooperate with rollers associated with the side walls of the tub 104. Alternatively, the middle dish rack 124 may be connected to a telescoping rail that allows the second rack to be extended out of the tub area when the door assembly 110 is open. The upper dish rack 126 may similar be mounted within the tub 104 along a pair of third track rails 136. Thus, as shown the dish racks 122, 124, 126 may be movable along their respective track rails 132, 134, 136 to allow the respective dish racks 122, 124, 126 to be slidable in and out of the access opening 106.

The dishwasher 100 may also include a spray system for spraying liquid within the tub 104 during a cleaning cycle. In an example cycle, washing liquid including soap may first be sprayed onto the kitchen equipment, and then once washed, rinsing liquid without soap may then be sprayed onto the kitchen equipment. The spray system may include various jets for providing the liquid onto the surfaces of dishes during the automated washing and rinsing operations. The spray system may include a bottom sprayer 142, middle sprayer 144, and a top sprayer 170. In some examples, one or more of the sprayers 142, 144, 170 are positioned at fixed locations within the tub 104. In other examples, one or more of the sprayers may be rotating spray arms with various nozzles configured to spray water onto the dishes maintained on the rack for cleaning. For instance, water jets on the spray arm may be angled so the water sprays out of the spray arms at an angle (e.g., ~45 degrees off the vertical) thereby causing the spray arms to rotate due to the pressure of the exiting water.

During loading, a user may open the door assembly 110 into the open position, pull the dish racks 122, 124, 126 from the tub 104, and load the kitchen equipment onto the dish racks 122, 124. Once completed, the user may push the dish racks 122, 124, 126 back into the tub 104, move the door assembly 110 back to the closed position, and initiate the cleaning cycle. Once the cleaning cycle has been completed, the user may again open the door assembly 110 to remove the cleaned kitchen equipment from the racks.

Figure 2:
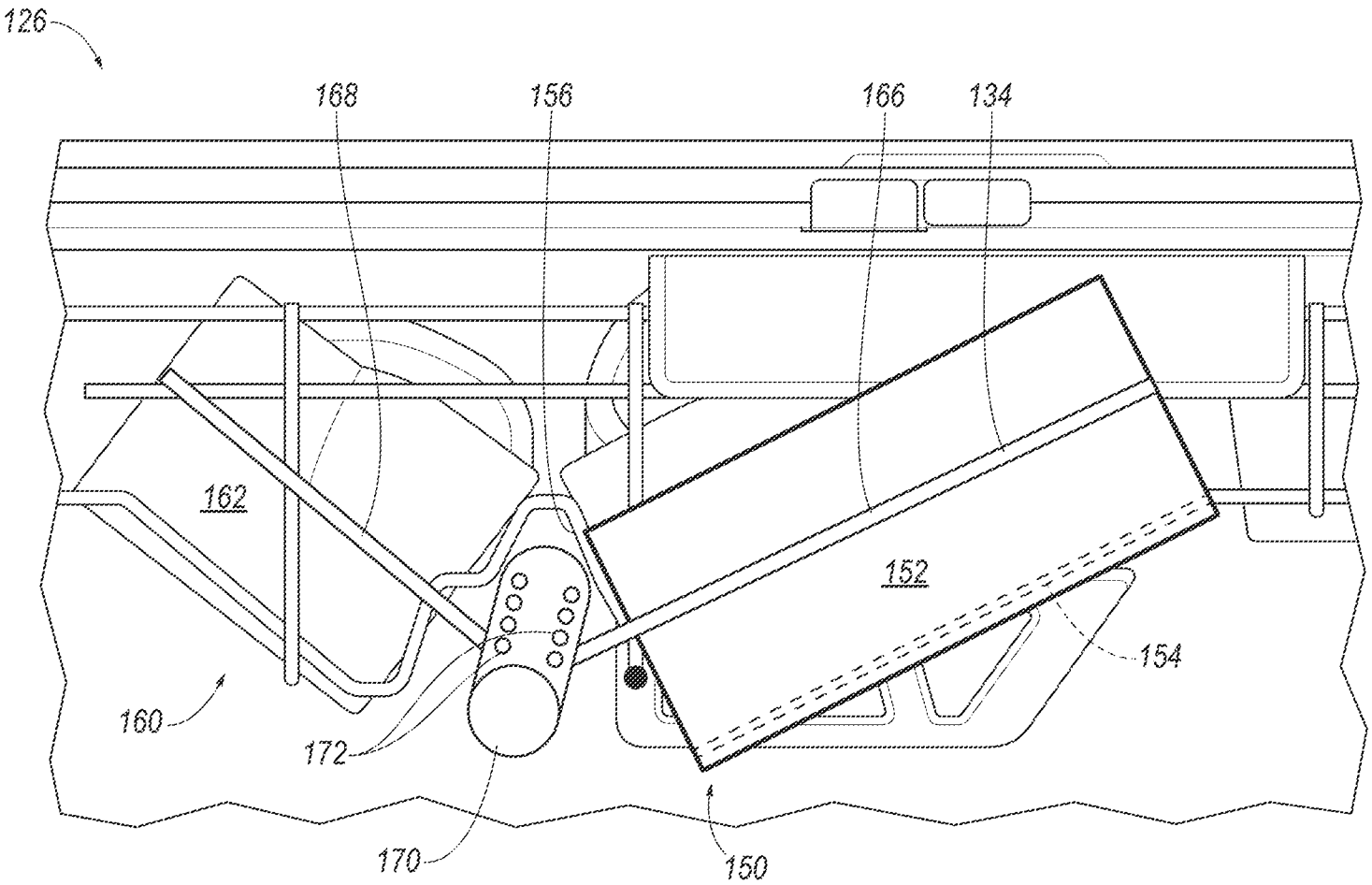
FIG. 2 illustrates a partial front view of an example upper rack of the dishwasher in accordance with one example embodiment.

FIG. 2 illustrates a partial front view of an example upper dish rack 126 of the dishwasher 100 in accordance with one example embodiment. The upper dish rack 126 may have a lower profile than the lower and middle dish racks 122, 124 and may be configured to hold items such as drinkware, as well as cooking items and kitchen utensils such as chopsticks, knives, silverware, measuring cups, whisks, spatulas, etc. The wire frame of the upper dish rack 126 may define a plurality of dish receptacle areas configured to receive different sizes and shapes of dish items. The dish rack 126 may define a first drinkware row 150 and a second drinkware row 160, each configured to receive drinkware such as tumblers, glasses, stemware, goblets, bottles, mugs, water bottles, baby bottles, thermoses, etc.

The first drinkware row 150 may be configured to receive tall drinkware 152 relative to the second drinkware row 160 that may be configured to receive short drinkware 162. For example, the tall drinkware 152 may include glasses and stemware with a greater height than the short drinkware 162 such as a coffee mug or short tumbler.

Each drinkware row 150, 160 may form a cradle or receptacle between a support wall 154 and a base wall 156 so that the drinkware may be maintained in position for washing. The support wall 154 may form a right-angle, or near right-angle, with the base wall 156, with each wall being arranged at opposing angles forming an angled cavity so that the drinkware 152, 162 may be arranged at a defined angle. An open side of the drinkware may be open to the base wall 156 during washing.

The top sprayer 170 may be arranged below the upper dish rack 126 between the first and second drinkware rows and may be configured to spray liquid into the drinkware 152, 162 during washing cycles. The sprayer 170 may be mounted to the upper dish rack 126 for movement with the upper dish rack 126 as the upper dish rack 126 is slid with respect to the tub 104. Alternatively, the sprayer 170 may be fixed to the tub 104 and maintain a fixed position relative to the tub when the upper dish rack 126 is in the expanded position. The sprayer 170 may be a tube or rod extended along the length of the upper dish rack 126 when the dish rack 126 is in the retracted position within the tub 104.

The sprayer 170 may form a plurality of spray nozzles 172 to allow the liquid to leave the sprayer 170. The nozzles 172 may extend the length of the sprayer 170 in an effort to provide multiple streams of liquid to the drinkware arranged in the first and second drinkware rows 150, 160. The sprayer 170 may be configured, via the nozzles 172, to provide for at least two liquid streams, one to each of the first and second drinkware rows 150, 160. In the example, at least one nozzle 172 may be arranged to provide a first liquid stream 166 to the first drinkware row 150 and a second liquid stream 168 to the second drinkware row 160. In one example, the sprayer 170 may define two sets of nozzles, one set for providing liquid to the first drinkware row 150, e.g., the first liquid stream 166, and another set for providing liquid to the second drinkware row 160, e.g., the second liquid stream 168. As shown, the liquid streams 166, 168 may spray directly into the drinkware 152, 162 to clean the inside of the drinkware 152, 162.

The spray nozzles 172 may provide the liquid at a water pressure to efficiently and effectively clean the inside of the drinkware 152, 162. The volume and velocity of the treating liquid emitted from the spray nozzles 172 may be based on the type of dish item contained within the upper dish rack 126, can be generic for all types of dish items, and/or can be variable from one treating cycle of operation to another and/or within a single treating cycle of operation. Additionally, the spray nozzles 172 may spray liquid alternately, continuously, and/or intermittently.

Although not specifically labeled in this example, additional upper rack sprayers may be arranged under the upper dish rack 126 to facilitate cleaning of portions of dish items. For example, another sprayer may be arranged under the upper dish rack 126 to facilities cleaning of the outside of the drinkware 152, 162.

Figure 3:
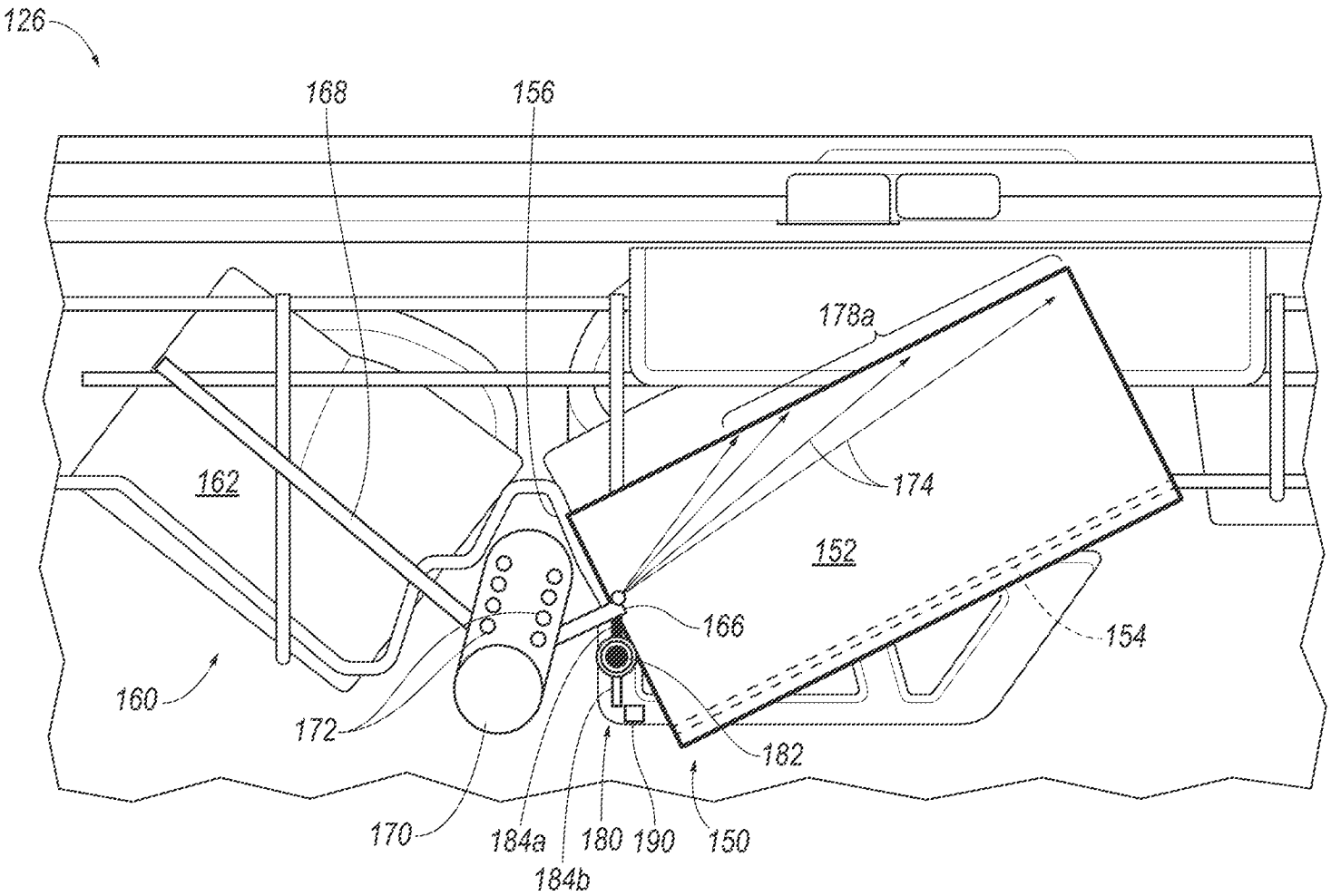
FIG. 3 illustrates a partial frontal view of the example upper rack of the dishwasher assembly including a paddle wheel assembly in a first position.

FIG. 3 illustrates a partial frontal view of another example upper dish rack 126 of the dishwasher assembly including a paddle wheel assembly 180 in a first position. In the example where the sprayer 170 is a fixed, non-rotating sprayer, the nozzles 172 may struggle to provide a liquid stream that can access and clean the various surfaces of the inside of the drinkware 152, 162. For example, one of the nozzles 172 may form a liquid stream configured to spray into the interior of one of the drinkware 152. However, this stream may sometimes only hit the bottom of the drinkware, and miss the sides, rim, etc.

The paddle wheel assembly 180 may be configured to deflect the liquid stream at various angles to provide the stream at various angles so as to contact each surface of the inside of the drinkware. The paddle wheel assembly 180 may include an axis rod 182 and at least one paddle 184 attached to and configured to rotate with respect to the rod 182. The rod 182 may extend along the length of the upper dish rack 126 and be attached to the upper dish rack 126 at or round the support wall 154 of the first drinkware row 150. Additionally or alternatively, the rod 182 may be a wire of the upper dish rack 126 and the paddle 184 may be arranged directly on the wire of the upper dish rack 126. In this example, the paddle wheel assembly 180 may include the paddle 184 as a single add on item that significantly increases the spray production of the sprayer 170 without substantial significant costs.

The at least one paddle 184 may extend the length of the upper dish rack 126 with the rod 182. Additionally or alternatively, the at least one paddle 184 may include a plurality of paddles 184 arranged around the rod 186, each configured to deflect liquid stream from at least one of the nozzles 172. The paddle 184 may include a first paddle 184*a* and a second paddle 184*b* arranged opposite the first paddle 184*a*. While the examples herein show two oppositely arranged paddles, more paddles may be included as part of the paddle 184. For example, three or more paddles may be included and may rotate about the rod 182. In another example, the paddle 184 may only include the first paddle 184*a* on one side of the rod 186.

The paddle assembly 180 may be installed on a wire of the rack 126. In one example, the paddle assembly 180 may include a hollow wheel with the paddles 184 extending therefrom. The wheel may be configured to surround the wire or rod 182. For installation purposes, the wheel may be semimalleable and define a slot such that the wheel is configured to slip over the rod 182 and then be maintained thereon.

In the example of FIG. 3, the first paddle 184*a* is extending vertically above the rod 182 and the second paddle 184*b* is extending vertically below the rod 182. The first paddle 184*a* may be of a first geometry and the second paddle 184*b* may be of a second geometry different and distinct from the first geometry. The first geometry may include a first length and the second geometry may include a second length, where the first length is greater than the second length. Additionally or alternatively, the first geometry may include a first width and the second geometry may include a second width, where the first width is lesser than the second width.

The paddle geometries may be large enough to obstruct the liquid stream 166 from the sprayer 170, but not so large as to come into contact with the drinkware 152 arranged in the first drinkware row 150.

Even further, the first paddle 184*a* may have a first weight greater than a second weight of the second paddle 184*b*. The paddles 184 may have differing weights so as to ensure that one of the paddles 184 is vertically upright in a resting position, as shown in FIG. 3. In the example shown, the second paddle 184*b* may weigh more than the first paddle 184*a*.

The sprayer 170 is arranged adjacent to the paddle wheel assembly 180 and is configured to provide at least one liquid stream, e.g., the first liquid stream 166, to the first drinkware row 150. However, instead of supplying the stream directly to the inside of the drinkware 152, the paddle wheel assembly 180 may intersect the liquid stream 166 prior to the stream reaching the drinkware 152. As shown, the liquid stream 166 may deflect off of the first paddle 184*a* creating a deflected stream 174. The deflected stream 174 may then hit the inside of the drinkware 152 at a series of first locations 178*a*. Once the deflected stream 174 makes contact at the first locations 178*a*, the liquid may further deflect off of those locations, and so on. However, the pressure decreases with each contact, and thus the contact at the first locations 178*a* may appreciate the most cleaning effectiveness.

As the liquid stream 166 hits the paddle 184, the paddle 184 may subsequently move in response to the pressure of the liquid stream 166. This may create subsequently deflected streams 174 configured to hit the inside of the drinkware 152 at a series of subsequent locations. That is, the liquid stream 166 may spin the paddle 184, creating a plurality of deflected streams 174, hitting the inside of the drinkware 152 at various locations 178 so as to apply liquid pressure to the entire, or nearly the entire, interior surface of the drinkware 152. Advantageously, this allows the paddle 184 to produce the various deflected streams 174 without being actively driven apart from the force of the liquid stream 166.

Figure 4:
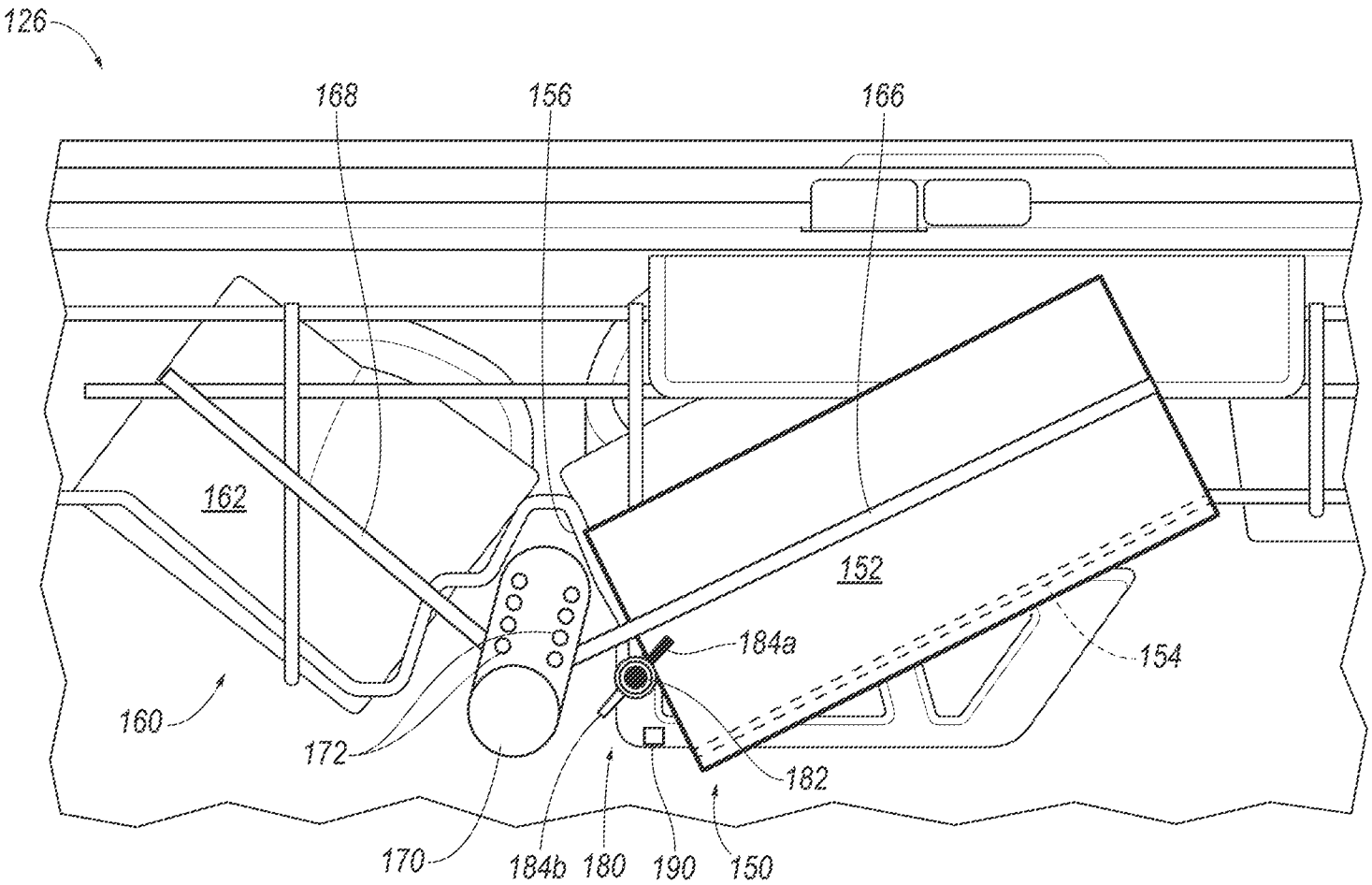
FIG. 4 illustrates a partial frontal view of the example upper rack of the dishwasher including the paddle wheel assembly in a second position.

FIG. 4 illustrates a partial frontal view of another example upper dish rack 126 of the dishwasher 100 including the paddle wheel assembly 180 in a second position. In the second position as illustrated in FIG. 4, the paddle wheel assembly 180 may not obstruct the liquid stream 166 and the liquid stream 166 may proceed to spray and clean the bottom of the drinkware 152. This may be achieved by the liquid stream 166 pushing the paddle 184 into the second position.

Figure 5:
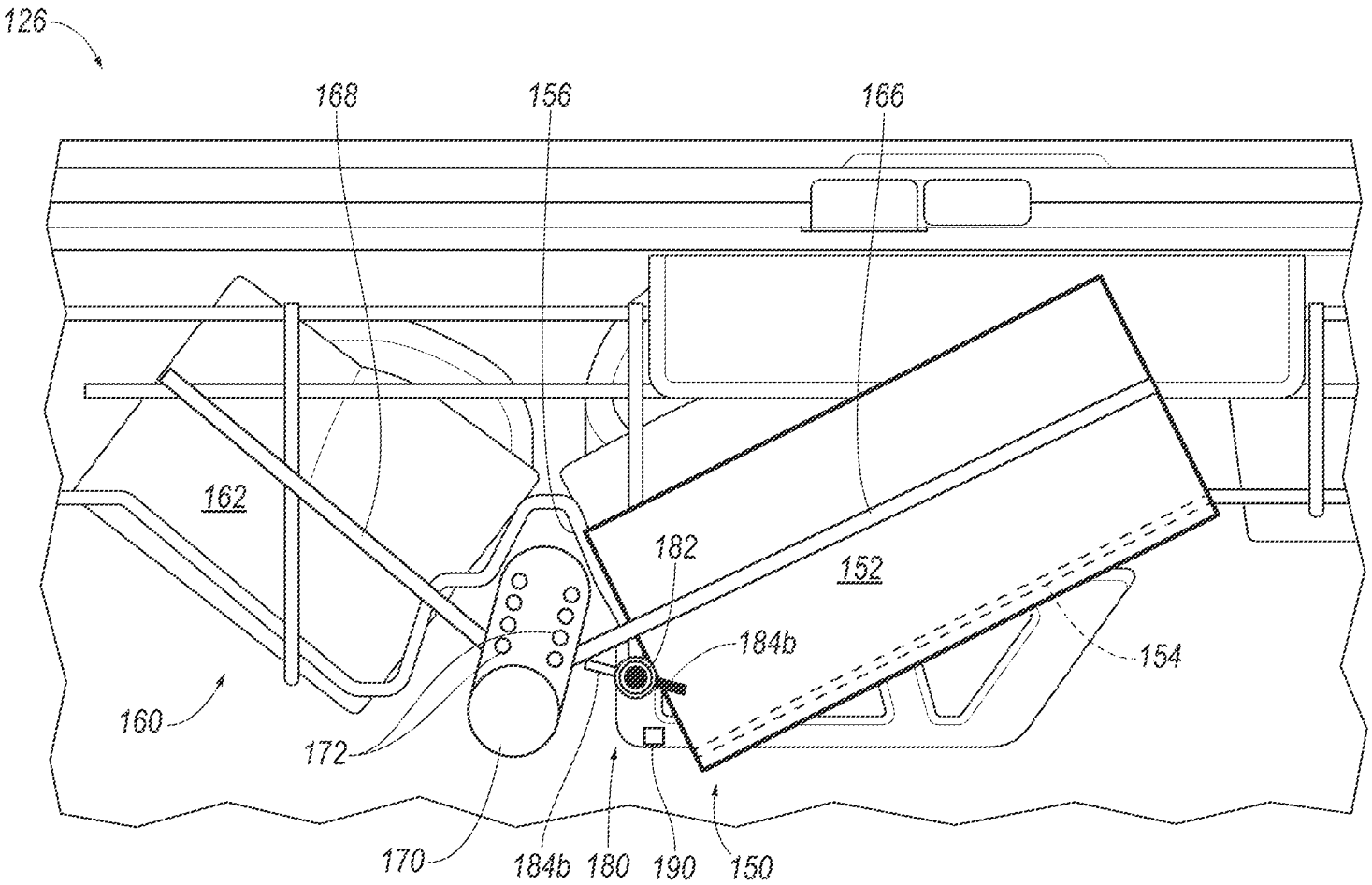
FIG. 5 illustrates a partial frontal view of the example upper rack of the dishwasher including the paddle wheel assembly in a third position.

FIG. 5 illustrates a partial frontal view of the example upper dish rack 126 of the dishwasher 100 including the paddle wheel assembly 180 in a third position. Similar to the second position illustrated in FIG. 4, FIG. 5 illustrates another example of the paddle 184 proceeding to not obstruct the liquid stream 166. The paddle 184 is in the third position and continues to move clockwise, at least in this example. The force created by the contact of the liquid stream 166 against the blade of the paddle 184 may create momentum and allow the paddle 184 to continue to rotate about the rod 182.

Figure 6:
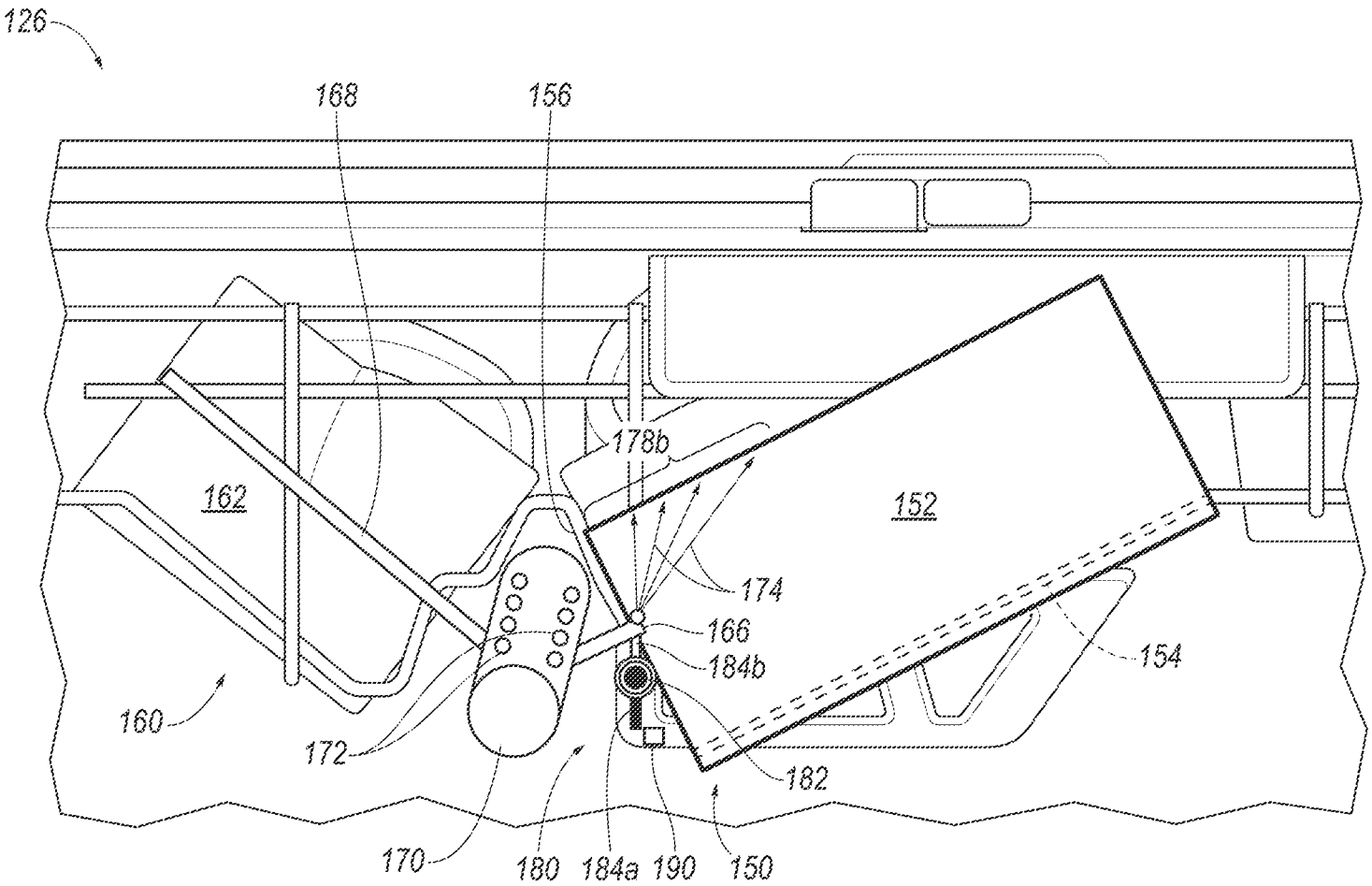
FIG. 6 illustrates a partial frontal view of the example upper rack of the dishwasher including the paddle wheel assembly in a fourth position.

FIG. 6 illustrates a partial frontal view of the example upper dish rack 126 of the dishwasher 100 including the paddle wheel assembly 180 in a fourth position. In this example, similar to that of FIG. 3, the paddle 184 may intercept the liquid stream 166 and create a deflected stream 174. In this example, however, the second paddle 184*b* is arranged vertically above the rod 182 with the first paddle 184*a* being arranged below the rod 182. In this arrangement, the second paddle 184*b*, which may have a shorter length than the first paddle 184*a*, may form a second spray pattern at second locations 178*b* on the interior of the drinkware 152. The shorter second paddle 184*b* allows the deflected stream 174 to hit additional areas of the drinkware 152 that may not have been hit by other deflections, such as the first locations 178*a*. The first locations 178*a* and second locations 178*b* labeled in the figures are simply examples and not intended to be limiting as several other spray patterns may be recognized.

The paddle wheel assembly 180 may include a stop 190 configured to abut the longer of the two paddles 184 in order to prevent the paddle 184 from continuously spinning about the rod 182. That is, the paddle wheel assembly 180 may be configured to limit rotation of the paddles 184 and stop the rotation. The stop 190 may be configured to cause the paddles 184 to bounce back in the opposite direction upon contact with the stop 190 (e.g., counter-clockwise). Thus, the paddles 148 may rotate back and forth so as to impose various spray patters on the drinkware 152.

In one example, the stop 190 may include a spring or other form of biasing member configured to absorb force from an object and subsequently deflect that object with an opposite force. They may ensure that the longer of the paddles 184 continues to rotate between a clockwise and counterclockwise rotation during spraying. The back and forward motion of the paddles 184 may allow for varying deflection of the liquid, allow for various spray patterns and more complete surface coverage within the drinkware.

Although the above paddle wheel assembly 180 is described with respect to the first drinkware row 150, a similar wheel assembly may also be arranged on the opposite side of the sprayer 170 to impart the same water-spreading effects on the second drinkware row 160. Further, a single, long paddle 184 may extend along the rod 182, or a series of multiple shorter paddles may be arranged along the rod 182 to impose the spray patterns described herein. Regardless of the paddle arrangement, the paddle assembly is configured to provide a varied spray pattern on each piece of drinkware 152, 162 arranged in the drinkware rows 150, 160.

Although certain examples are described above with respect to drinkware, similar techniques may be used to aid in the washing of other low profile items having an opening to an internal area, such as, for example, bottles, bowls, condiment containers, and the like. Dish items may include the examples given herein in addition to others not listed herein. The dish items can be made of any suitable material, including glass, ceramics, plastic, and metals and are not limited to glass materials. Throughout the description and examples herein, the upper dish rack 126 is described as including the paddle wheel assembly 180, as the uppermost dish rack in the tub 104 is commonly provided as a low profile rack compared to the other, lower dish racks. However, it will be understood that the paddle wheel assembly 180 may be applied to racks other than the upper dish rack 126, and similar paddle wheel assemblies 180 and drinkware rows 150, 160 may be included in the middle and lower dish racks 122, 124 as well.

Accordingly, a low-cost, low profile, singular part solution is described herein to affect various and effective spray patterns on a drinkware item so as to improve the cleaning of the items without requiring the mechanism of a rotational sprayer.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A dishwasher assembly, comprising:

a rack having a front and a back connected by parallel sides, the rack including at least one row configured to hold drinkware along the row which extends a length of the rack between the front of the rack and the back of the rack;

a sprayer extending the length of the rack between the front of the rack and the back of the rack and defining a plurality of nozzles spaced along a length of the sprayer, each nozzle configured to provide at least one stream of liquid; and a paddle wheel assembly arranged adjacent and parallel to the sprayer and including an axis rod extending the length of the sprayer, the paddle wheel assembly further including at least one paddle wheel arranged on the axis rod and configured to rotate about the axis rod responsive to a force of the stream of liquid, the paddle wheel including a first paddle extending along the axis rod and a second paddle extending along the axis rod at an opposite side of the axis rod than the first paddle, the first and second paddles configured to rotate about the axis rod responsive to force of the at least one stream of liquid against each paddle, wherein the first paddle extends from the axis rod to a different radial length than the second paddle such that each paddle is configured to variably deflect at least a portion of the at least one stream of liquid onto a plurality of portions of an interior surface of the drinkware arranged along the row.

2. The dishwasher assembly of claim 1, wherein the first paddle is configured to variably deflect at least a portion of the at least one stream of liquid at a different spray pattern than that of the second paddle generating a plurality of deflected streams for cleaning the drinkware.

3. The dishwasher assembly of claim 1, wherein one of the first and second paddles has a greater weight than the other one of the first and second paddles to maintain the paddle wheel assembly in a resting position absent a force imposed by the stream of liquid from the sprayer.

4. The dishwasher assembly of claim 1, further comprising at least one stop configured to abut at least one of the first and second paddles to prevent continuous rotation of the paddle wheel.

5. The dishwasher assembly of claim 4, wherein the stop is a spring configured to propel the at least one paddle back in an opposite rotational direction to the rotational direction created to by the force of the at least one stream of liquid to interact with the stream of liquid from the opposite side of the at least one paddle.

6. The dishwasher assembly of claim 1, wherein the paddle wheel assembly includes a plurality of paddle wheels arranged along the length of the rack to deflect water from the sprayer to the row.

* * * * *